US007790661B2

(12) United States Patent
Covitch et al.

(10) Patent No.: US 7,790,661 B2
(45) Date of Patent: Sep. 7, 2010

(54) DISPERSANT VISCOSITY MODIFIERS CONTAINING AROMATIC AMINES

(75) Inventors: Michael J. Covitch, Cleveland Heights, OH (US); John K. Pudelski, Cleveland Heights, OH (US); Christopher Friend, Bobbersmill (GB); Matt D. Gieselman, Willoughby Hills, OH (US); Renee A. Eveland, Concord Township, OH (US); Mary Galic Raguz, Mentor, OH (US); Barton J. Schober, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 1111 days.

(21) Appl. No.: 11/192,653

(22) Filed: Jul. 29, 2005

(65) Prior Publication Data

US 2006/0025316 A1 Feb. 2, 2006

Related U.S. Application Data

(60) Provisional application No. 60/592,566, filed on Jul. 30, 2004.

(51) Int. Cl.
*C10M 149/14* (2006.01)

(52) U.S. Cl. ..... 508/528

(58) Field of Classification Search ..... 508/459
See application file for complete search history.

(56) References Cited

U.S. PATENT DOCUMENTS

| | | | | | |
|---|---|---|---|---|---|
| 3,450,715 | A | | 6/1969 | Lindstrom et al. | |
| 4,132,661 | A | | 1/1979 | Waldbillig et al. | |
| 4,204,970 | A | * | 5/1980 | Lee et al. | 508/291 |
| 4,863,623 | A | | 9/1989 | Nalesnik et al. | |
| 4,981,915 | A | | 1/1991 | MacLeay et al. | |
| 5,055,213 | A | | 10/1991 | Germanaud et al. | |
| 5,264,139 | A | | 11/1993 | Mishra et al. | |
| 5,264,140 | A | | 11/1993 | Mishra et al. | |
| 5,356,999 | A | | 10/1994 | Kapuscinski et al. | |
| 5,409,623 | A | * | 4/1995 | Mishra et al. | 508/184 |
| 5,429,757 | A | | 7/1995 | Mishra et al. | |
| 5,563,118 | A | | 10/1996 | Mishra et al. | |
| 5,620,486 | A | | 4/1997 | Cherpeck | |
| 5,633,326 | A | * | 5/1997 | Patil et al. | 525/327.6 |
| 5,744,429 | A | * | 4/1998 | Chung et al. | 508/221 |
| 5,756,434 | A | * | 5/1998 | Patil et al. | 508/508 |
| 6,025,308 | A | | 2/2000 | Matsuya et al. | |
| 6,100,224 | A | * | 8/2000 | Peiffer et al. | 508/235 |
| 6,107,257 | A | | 8/2000 | Valcho et al. | |
| 6,107,258 | A | | 8/2000 | Esche et al. | |
| 6,114,542 | A | | 9/2000 | Cherpeck | |
| 6,117,825 | A | | 9/2000 | Liu et al. | |
| 6,187,721 | B1 | | 2/2001 | Goldblatt et al. | |
| 6,284,716 | B1 | | 9/2001 | Günther et al. | |
| 6,329,328 | B1 | * | 12/2001 | Koganei et al. | 508/365 |
| 2003/0220209 | A1 | * | 11/2003 | Curtis et al. | 508/551 |
| 2004/0043909 | A1 | | 3/2004 | Goldblatt et al. | |
| 2004/0048753 | A1 | | 3/2004 | Ritchie et al. | |
| 2004/0259742 | A1 | * | 12/2004 | Mishra et al. | 508/231 |
| 2005/0153849 | A1 | | 7/2005 | Mishra et al. | |

FOREIGN PATENT DOCUMENTS

| | | | |
|---|---|---|---|
| EP | 721010 | A1 * | 7/1996 |
| GB | 768 701 | | 2/1957 |
| GB | 2 033 907 | | 5/1980 |
| WO | 98/17696 | | 4/1998 |
| WO | WO 0246251 | A2 * | 6/2002 |
| WO | PCT/US2005/007544 | | 3/2005 |
| WO | PCT/US2005/013159 | | 4/2005 |
| WO | 2005/087821 | | 9/2005 |

OTHER PUBLICATIONS

SAE Technical Paper 2001-01-1967, Parry et al., May 7-9, 2001, "Understanding Soot Mediated Oil Thickening: Rotational Rheology Techniques to Determine Viscosity and Soot Structure . . . ".

* cited by examiner

*Primary Examiner*—Glenn A Caldarola
*Assistant Examiner*—Taiwo Oladapo
(74) *Attorney, Agent, or Firm*—David M. Shold; Christopher D. Hilker

(57) ABSTRACT

Reaction of a carboxylic acid-containing polymer with certain aromatic amines results in dispersant viscosity modifiers with improved soot handling performance in heavy-duty diesel engines, compared with reaction with non-aromatic amines.

23 Claims, No Drawings

DISPERSANT VISCOSITY MODIFIERS CONTAINING AROMATIC AMINES

This patent application claims priority from U.S. Provisional Application 60/592,566, filed Jul. 30, 2004.

BACKGROUND OF THE INVENTION

The present invention relates to dispersants for use in fuels and in engine oil lubricants, especially for reducing soot-induced viscosity increase in heavy duty diesel engine lubricants.

Heavy duty diesel vehicles may use exhaust gas recirculation (EGR) engines in efforts to reduce environmental emissions. Among the consequences of recirculating the exhaust gas through the engine are different soot structures and increased viscosity of the oil at lower soot levels, compared with engines without EGR. It is desirable that oil exhibit minimal viscosity increase, e.g., less than 12 $mm^2$/sec (cSt) at 100° C. at a soot loading of 6 weight %.

It is also desirable that a lubricating oil composition maintain a relatively stable viscosity over a wide range of temperatures. Viscosity improvers are often used to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved.

Traditional dispersant viscosity modifiers (DVMs) made from ethylene-propylene copolymers that have been radically grafted with maleic anhydride and reacted with various amines have shown desirable performance to prevent oil thickening in diesel engines. Aromatic amines are said to show good performance in this regard. DVMs of this type are disclosed in, for instance, U.S. Pat. No. 4,863,623, Nalesnik et al., Sep. 5, 1989; U.S. Pat. No. 6,107,257, Valcho et al., and U.S. Pat. No. 6,107,258, Esche et al., each Aug. 22, 2000, and U.S. Pat. No. 6,117,825, Liu et al., Sep. 12, 2000.

U.S. Pat. No. 5,409,623, Mishra et al., Apr. 25, 1995, discloses functionalized graft copolymers as viscosity index improvers, comprising an ethylene alpha-monoolefin copolymer grafted with an ethylenically unsaturated carboxylic acid material and derivatized with an azo-containing aromatic amine compound. U.S. Pat. No. 5,264,140, Mishra et al, Nov. 23, 1993, discloses similar polymers derivatized with an amide-containing aromatic amine material. U.S. Pat. No. 5,264,139, Mishra et al., Nov. 23, 1993, discloses similar polymers derivatized with a sulfonyl-containing aromatic amine material. U.S. Pat. No. 5,620,486, Cherpeck, Apr. 15, 1997, discloses fuel compositions containing aryl succinimides, that is, an effective detergent amount of a compound of the formula

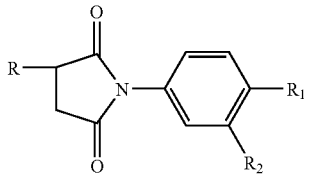

wherein R is a hydrocarbyl group having an average molecular weight of about 400 to 5,000; and $R_1$ and $R_2$ are independently selected from the group consisting of hydrogen, hydroxy, —$CO_2H$, —$NO_2$, and —$NR_3R_4$. A fuel soluble nonvolatile carrier fluid or oil may also be used with the aryl succinimide.

The present invention, therefore, solves the problem of providing a low cost dispersant viscosity modifier having improved performance in engine tests, providing a good viscosity index and good soot dispersion and toleration properties, particularly in diesel engines, and especially in heavy duty diesel engines employing exhaust gas recirculation.

SUMMARY OF THE INVENTION

The present invention provides method for lubricating a diesel engine equipped with exhaust gas recirculation, comprising supplying thereto a composition comprising the reaction product of: (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine is selected from the group consisting of (i) a nitro-substituted aniline, (ii) amines comprising two aromatic moieties linked by a —C(O)NR— group, a —C(O)O— group, an —O— group, an —N═N— group, or an —$SO_2$— group where R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine.

The present invention further provides a lubricant composition comprising an oil of lubricating viscosity having a kinematic viscosity at 100° C. of at least 3.5 $mm^2$/second and the reaction product of a polymer comprising carboxylic acid functionality or a reactive equivalent thereof, said polymer having a number average molecular weight of greater than 5,000, and an amine component comprising 3-nitroaniline. The invention also provides a method of lubricating an internal combustion engine, comprising supplying thereto such a lubricant composition.

DETAILED DESCRIPTION OF THE INVENTION

Various preferred features and embodiments will be described below by way of non-limiting illustration.

The polymer or copolymer substrate employed in the novel derivatized graft copolymer of the invention is not particularly limited, provided that it contains carboxylic acid functionality or a reactive equivalent of carboxylic acid functionality (e.g., anhydride or ester). The polymer may contain the reactive carboxylic acid functionality as a monomer copolymerized within the chain, or it may be present as a pendant group attached by, for instance, a grafting process. Examples of suitable carboxylic-acid containing polymers include maleic anhydride-styrene copolymers, including partially esterified versions thereof. Nitrogen-containing esterified carboxyl-containing interpolymers prepared from maleic anhydride and styrene-containing polymers are known from U.S. Pat. No. 6,544,935, Vargo et al. Other polymer backbones have also been used for preparing dispersants. For example, polymers derived from isobutylene and isoprene have been used in preparing dispersants and are reported in PCT publication WO 01/98387. Other polymer backbones include substantially hydrogenated copolymers of vinyl aromatic materials such as styrene and unsaturated hydrocarbons such as conjugated dienes, e.g., butadiene or isoprene. In substantially hydrogenated polymers of this type the olefinic unsaturation is typically substantially completely hydrogenated by known methods, but the aromatic unsaturation may remain. Such polymers can include random copolymers, block copolymers, or star copolymers. Yet other suitable backbone polymers include styrene-ethylene-alpha olefin polymers, as described in PCT publication WO 01/30947, and polyacrylates or polymethacrylates. In the case of such poly(meth)acrylates, the (meth)acrylate monomers within the polymer chain itself may serve as the carboxylic acid functionality or reactive equivalent thereof which is used to react with the amine component, described below. Alternatively, additional acid functionality may be copolymerized into the (meth)acrylate chain or even grafted onto it, particularly in the case of acrylate polymers.

In certain embodiments, the polymer may be prepared from ethylene and propylene or it may be prepared from ethylene and a higher olefin within the range of ($C_3$-$C_{10}$) alpha-monoolefins, in either case grafted with a suitable carboxylic acid-containing species (i.e., monomer).

More complex polymer substrates, often designated as interpolymers, may be prepared using a third component. The third component generally used to prepare an interpolymer substrate is a polyene monomer selected from conjugated or non-conjugated dienes and trienes. The non-conjugated diene component is one having from about 5 to about 14 carbon atoms. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more than one diene can be used in the preparation of the interpolymer.

The triene component will have at least two non-conjugated double bonds and up to about 30 carbon atoms. Typical trienes useful in preparing the interpolymer of the invention are 1-isopropylidene-3a,4,7,7a-tetrahydroindene, 1-isopropylidenedicyclopentadiene, and 2-(2-methylene-4-methyl-3-pentenyl)-[2.2.1]bicyclo-5-heptene.

Suitable backbone polymers of the olefin polymer variety include ethylene propylene copolymers, ethylene propylene copolymers further containing a non-conjugated diene, and isobutylene/conjugated diene copolymers, each of which can be subsequently supplied with grafted carboxylic functionality.

The polymerization reaction to form the olefin polymer substrate is generally carried out in the presence of a catalyst in a solvent medium. The polymerization solvent may be any suitable inert organic solvent that is liquid under reaction conditions for solution polymerization of monoolefins, which can be conducted in the presence of a Ziegler-Natta type catalyst or a metallocene catalyst.

In a typical preparation of a polymer substrate, hexane is first introduced into a reactor and the temperature in the reactor is raised moderately to about 30° C. Dry propylene is fed to the reactor until the pressure reaches about 130-150 kPa above ambient (40-45 inches of mercury). The pressure is then increased to about 200 kPa (60 inches of mercury) by feeding dry ethylene and 5-ethylidene-2-norbornene to the reactor. The monomer feeds are stopped and a mixture of aluminum sesquichloride and vanadium oxytrichloride is added to initiate the polymerization reaction. Completion of the polymerization reaction is evidenced by a drop in the pressure in the reactor.

Ethylene-propylene or higher alpha monoolefin copolymers may consist of 15 to 80 mole % ethylene and 20 to 85 mole % propylene or higher monoolefin, in some embodiments, the mole ratios being 30 to 80 mole % ethylene and 20 to 70 mole % of at least one $C_3$ to $C_{10}$ alpha monoolefin, for example, 50 to 80 mole % ethylene and 20 to 50 mole % propylene. Terpolymer variations of the foregoing polymers may contain up to 15 mole % of a non-conjugated diene or triene.

In these embodiments, the polymer substrate, that is, typically the ethylene copolymer or terpolymer, can be an oil-soluble, substantially linear, rubbery material. Also, in certain embodiments the polymer can be in forms other than substantially linear, that is, it can be a branched polymer or a star polymer. The polymer can also be a random copolymer or a block copolymer, including di-blocks and higher blocks, including tapered blocks and a variety of other structures. These types of polymer structures are known in the art and their preparation is within the abilities of the person skilled in the art.

The polymer of the present invention may have a number average molecular weight (by gel permeation chromatography, polystyrene standard), which can typically be up to 150,000 or higher, e.g., 1,000 or 5,000 to 150,000 or to 120,000 or to 100,000, e.g., 10,000 to 50,000 and especially 10,000 to 15,000 (e.g., about 12,000) or 30,000 to 50,000 (e.g., about 40,000). In one embodiment, the polymer (that is, the polymer absent the amine component) has a number average molecular weight of greater than 5,000, for instance, greater than 5000 to 150,000. Other combinations of the above-identified molecular weight limitations are also contemplated.

The terms polymer and copolymer are used generically to encompass ethylene and/or higher alpha monoolefin polymers, copolymers, terpolymers or interpolymers. These materials may contain minor amounts of other olefinic monomers so long as their basic characteristics are not materially changed.

An ethylenically unsaturated carboxylic acid material is typically grafted onto the polymer backbone. These materials which are attached to the polymer typically contain at least one ethylenic bond (prior to, reaction) and at least one, preferably two, carboxylic acid (or its anhydride) groups or a polar group which is convertible into said carboxyl groups by oxidation or hydrolysis. Maleic anhydride or a derivative thereof is suitable. It grafts onto the ethylene copolymer or terpolymer to give two carboxylic acid functionalities. Examples of additional unsaturated carboxylic materials include chlormaleic anhydride, itaconic anhydride, or the corresponding dicarboxylic acids, such as maleic acid, fumaric acid and their esters.

The ethylenically unsaturated carboxylic acid material may be grafted onto the polymer (preferably an ethylene/propylene copolymer) in a number of ways. It may be grafted onto the polymer in solution or in molten form using a radical initiator. The free-radical induced grafting of ethylenically unsaturated carboxylic acid materials may also be conducted in solvents, such as hexane or mineral oil. It may be carried out at an elevated temperature in the range of 100° C. to 250° C., e.g., 120° C. to 190° C., or 150° C. to 180° C., e.g., a If it is conducted in a solvent such as a mineral lubricating oil solution, the solution may contain, e.g., 1 to 50 wt. %, or 5 to 30 wt. %, based on the initial total oil solution, of the ethylene/propylene copolymer, typically under an inert environment.

The free-radical initiators which may be used include peroxides, hydroperoxides, and azo compounds, typically those which have a boiling point greater than about 100° C. and which decompose thermally within the grafting temperature range to provide free radicals. Representative of these free-radical initiators include azobisisobutyronitrile and 2,5-dimethyl-hex-3-yne-2,5-bis-tertiary-butyl peroxide. The initiator is typically used in an amount of 0.005% to 1% by weight based on the weight of the reaction mixture solution. The grafting is typically carried out in an inert atmosphere, such as under nitrogen blanketing. The resulting polymer intermediate is characterized by having carboxylic acid acylating functions within its structure.

In a melt process for forming a graft polymer, the unsaturated carboxylic acid with the optional use of a radical initiator is grafted onto molten rubber using rubber masticating or shearing equipment. The temperature of the molten material in this process may be 150° C. to 400° C. Optionally, as a part of this process or separate from this process, mechanical shear and elevated temperatures can be used to reduce the molecular weight of the polymer to a value that will eventually provide the desired level of shear stability for the lubricant application. In one embodiment, such mastication can be done in a twin screw extruder properly configured to provide high shear zones, capable of breaking down the polymer to the desired molecular weight. Shear degradation can be done before or after grafting with the maleic anhydride. It can be done in the absence or presence of oxygen. The shearing and grafting steps can be done in the same extruder or in separate extruders, in any order.

In an alternative embodiment, the unsaturated carboxylic acid materials, such as maleic anhydride, can be first condensed with an aromatic amine (described below) and the condensation product itself then grafted onto the polymer backbone in analogous fashion to that described above.

The amount of the reactive carboxylic acid on the polymer chain, and in particular the amount of grafted carboxylic acid on the chain is typically 1 to 5 weight percent based on the weight of the polymer backbone, and in an alternative embodiment, 1.5 to 3.5 or 4.0%. These numbers represent the amount of carboxylic-containing monomer such as maleic anhydride and may be adjusted to account for acid monomers having higher or lower molecular weights or greater or lesser amounts of acid functionality per molecule, as will be apparent to the person skilled in the art.

The carboxylic acid functionality can also be provided by a graft process with glyoxylic acid or its homologues or a reactive equivalent thereof of the general formula $R^3C(O)(R^4)_nC(O)OR^5$. In this formula $R^3$ and $R^5$ are hydrogen or hydrocarbyl groups and $R^4$ is a divalent hydrocarbylene group. n is 0 or 1. Also include are the corresponding acetals, hemiacetals, ketals, and hemiketals. Preparation of grafts of such glyoxylic materials onto hydrocarbon-based polymers is described in detail in U.S. Pat. No. 6,117,941.

The polymer intermediate possessing carboxylic acid acylating functions is reacted with an amine component comprising at least one aromatic amine containing at least one amino group capable of condensing with said carboxylic acid functionality to provide a pendant group, and additionally containing at least one additional group comprising at least one nitrogen, oxygen, or sulfur atom. The aromatic amine is selected from the group consisting of (i) a nitro-substituted aniline, (ii) amines comprising two aromatic moieties linked by an —O— group, an —N═N— group, a —C(O)NR— group, a —C(O)O— group, or an —$SO_2$— group where R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine. (The term "condensing" or "condensation reaction" is used herein to denote formation of an amide or imide, even if, as in the case of an anhydride reactant, no water of condensation is formed if, e.g., the reaction is with a secondary amine.)

The reaction between the polymer substrate intermediate having carboxylic acid functionality and the amino-aromatic compound is conducted by heating a solution of the polymer under inert conditions and then adding the amino-aromatic compound to the heated solution, generally with mixing, to effect the reaction. It is convenient to employ an oil solution of the polymer substrate heated to about 140° C. to about 175° C. while maintaining the solution under a nitrogen blanket. The amino-aromatic compound is added to this solution and the reaction is effected under the noted conditions. Reaction can also be conducted in a melt of the polymer, e.g., in a an extruder or other shearing/mixing environment. Vacuum may be applied to the reaction mixture if desired, e.g., to remove water and aid in driving the reaction to completion.

The aromatic amine can be an amine comprising two linked aromatic moieties. By the term "aromatic moiety is meant to include both mononuclear and polynuclear groups. The polynuclear groups can be of the fused type wherein an aromatic nucleus is fused at two points to another nucleus such as found in naphthyl or anthranyl groups. The polynuclear group can also be of the linked type wherein at least two nuclei (either mononuclear or polynuclear) are linked through bridging linkages to each other. These bridging linkages can be chosen from, among others known to those skilled in the art, alkylene linkages, ether linkages, ester linkages, keto linkages, sulfide linkages, polysulfide linkages of 2 to 6 sulfur atoms, sulfone linkages, sulfonamide linkages, amide linkages, azo linkages, and direct carbon-carbon linkages between the groups without any intervening atoms. Other aromatic groups include those with heteroatoms, such as pyridine, pyrazine, pyrimidine, and thiophene. Examples of the aromatic groups that are useful herein include the aromatic groups derived from benzene, naphthalene, and anthracene, preferably benzene. Each of these various aromatic groups may also be substituted by various substituents, including hydrocarbyl substituents.

The aromatic amine can be an amine comprising two aromatic moieties linked by an —O— group. An example of such an amine is phenoxyphenylamine, also known as phenoxyaniline or aminophenyl phenyl ether, which can be represented by

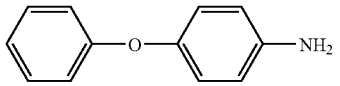

and its various positional isomers (4-phenoxy, 3-phenoxy, and 2-phenoxy-aniline). Either or both of the aromatic groups can bear substituents, including hydrocarbyl, amino, halo, sulfoxy, hydroxy, nitro, carboxy, and alkoxy substituents. The amine nitrogen can be a primary amine nitrogen, as shown, or it can be secondary, that is, bearing a further substituent such as hydrocarbyl, preferably short chain alkyl such as methyl. In one embodiment, the aromatic amine is the unsubstituted material shown above.

The aromatic amine can be an amine comprising two aromatic moieties linked by an —N═N— group, an azo group. Such a material can be represented by the following structure:

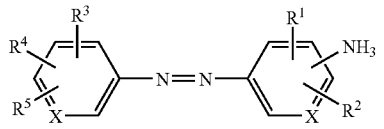

wherein each X is independently N or CH and the R groups are hydrogen or substituents as described above for the phenoxyphenylamine. Thus, each or $R^1$ and $R^2$ can independently be H, —$NH_2$, hydrocarbyl or alkyl such as —$CH_3$, halo such as —Cl, sulfoxy such as —$SO_3H$, or —$SO_3Na$; and each of $R^3$, $R^4$, and $R^5$ is independently H, —OH, —$NO_2$, —$SO_3H$, carboxy such as —$CO_2Na$, or alkoxy such as —$OC_4H_9$. These materials are described in greater detail in U.S. Pat. No. 5,409,623, see column 4.

In one embodiment the azo-linked aromatic amine is represented by the formula

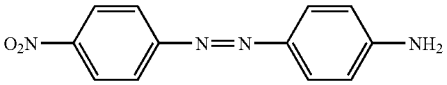

that is, 4-(4-nitrophenylazo)aniline, as well as positional isomers thereof. The material shown is commercially available as a dye known as Disperse Orange 3.

The aromatic amine can be an amine comprising two aromatic moieties linked by a —C(O)NR— group, that is an amide linkage, where R is hydrogen or hydrocarbyl. Each group may be substituted as described above for the oxygen-linked and the azo-linked amines. In one embodiment this amine is represented by the structure

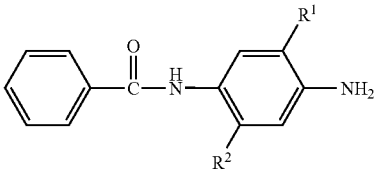

and positional isomers thereof; wherein each of $R^1$ and $R^2$ is independently H, —$CH_3$, —$OCH_3$, or —$OC_2H_5$. Likewise, the orientation of the linking amido group can be reversed, to —NR—C(O)—.

In certain embodiments, both $R^1$ and $R^2$ can be hydrogen, in which case the amine is p-amino benzanilide. When $R^1$ is methoxy and $R^2$ is methyl, the material is a commercially available dye known as Fast Violet B. When both $R^1$ and $R^2$ are both methoxy, the material is a commercially available dye known as Fast Blue RR. When both $R^1$ and $R^2$ are ethoxy, the material is a commercially available dye known as Fast Blue BB. In another embodiment, the amine can be 4-aminoacetanilide.

In one embodiment aromatic amine can be an amine comprising two aromatic moieties linked by a —C(O)O— group. Each group may be substituted as described above for the oxygen-linked and the azo-linked amines. In one embodiment this amine is represented by the formula

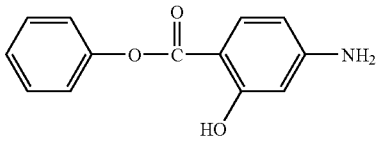

as well as positional isomers thereof. The material shown is phenyl-4-amino salicylate or 4-amino-2-hydroxy benzoic acid phenyl ester, which is commercially available.

The aromatic amine can be an amine comprising two aromatic moieties linked by an —$SO_2$— group. Each of the aromatic moieties can be substituted as described above for the oxygen-linked and the azo-linked amines. In one embodiment the linkage, in addition to —$SO_2$—, further contains an —NR— or specifically an —NH— group, so that the entire linkage is —$SO_2NR$— or —$SO_2NH$—. In one embodiment, this aromatic amine is represented by the structure

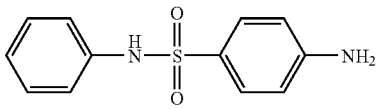

The structure as shown is that of 4-amino-N-phenyl-benzenesulfonamide. A commercially available variation thereof is sulfamethazine, or N'-(4,6-dimethyl-2-pyrimidinyl)sulfanilamide (CAS # 57-68-1) which is believed to be represented by the structure

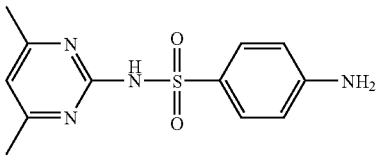

Sulfamethazine is commercially available.

The aromatic amine can be a nitro-substituted aniline, which, can, likewise, bear the substituents as described above for the oxygen-linked and the azo-linked amines. Included are the ortho-, meta-, and para-substituted isomers of nitroaniline. In one embodiment the amine is 3-nitro-aniline.

The aromatic amine can also be an aminoquinoline. Commercially available materials include 3-aminoquinoline, 5-aminoquinoline, 6-aminoquinoline, and 8-aminoquinoline and homologues such as 4-aminoquinaldine.

The aromatic amine can also be an aminobenzimidazole such as 2-aminobenzimidazole.

The aromatic amine can also be an N,N-dialkylphenylenediamine such as N,N-dimethyl-1,4-phenylenediamine.

The aromatic amine can also be a ring-substituted benzylamine, with various substituents as described above. One such benzyl amine is 2,5-dimethyoxybenzylamine.

The aromatic amine may, in general, contain one or more reactive (condensable) amino groups. A single reactive amino group is sometimes preferred. Multiple amino groups, as in the case of the above described N,N-dimethylphenylenediamines, can be useful as well, especially if they are reacted under relatively mild conditions so as to avoid excessive crosslinking or gellation of the polymer.

The above-described aromatic amines can be used alone or in combination with each other. They can also be used in combination with additional, aromatic or non-aromatic, e.g., aliphatic, amines, which, in one embodiment, comprise 1 to 8 carbon atoms. Other aromatic amines can include such amines as aminodiphenylamine. These additional amines can be included for a variety of reasons. Sometimes it may be desirable to incorporate an aliphatic amine in order to assure complete reaction of the acid functionality of the polymer, in the event that some residual acid functionality may tend to react incompletely with the relatively more bulky aromatic amine. Alternatively, the aliphatic amine may replace a portion of a more costly aromatic amine, while maintaining the majority of the performance of the aromatic amine. Aliphatic monoamines include methylamine, ethylamine, propylamine and various higher amines. Diamines or polyamines can be used for this function, provided that, in general, they have only a single reactive amino group, that is, a primary or secondary, and preferably primary, group. Suitable examples of diamines include dimethylaminopropylamine, diethylaminopropylamine, dibutyl aminopropyl amine, dimethylaminoethylamine, diethylaminoethylamine, dibutylaminoethylamine, 1-(2-aminoethyl)piperidine, 1-(2-aminoethyl) pyrrolidone, aminoethylmorpholine, and aminopropylmorpholine. The amount of such an amine is typically a minor amount compared with the amount of the aromatic amine, that is, less than 50% of the total amine present on a weight or molar basis, although higher amounts can be used, such as 70 to 130% or 90 to 110%. Exemplary amounts include 10 to 70 weight percent, or 15 to 50 weight percent, or 20 to 40 weight percent. Use of certain combinations of 4-phenoxyaniline with dimethylaminopropylamine within these ranges, for instance, provides particularly good performance in terms of soot suspension. In certain embodiments, the polymers may be functionalized with three or more different amines, for instance, with 3-nitroaniline, 4-(4-nitrophenylazo)aniline, and dimethylaminopropylamine.

Some high molecular weight maleic anhydride grafted olefin copolymers, reacted with equimolar or molar excesses of 3-nitroaniline, when blended into a fully-formulated heavy duty diesel oil, may give undesirably high kinematic viscosities. It has been found that including an aliphatic amine may alleviate this problem. For example, a 3-nitroaniline-containing dispersant polymer can be post-treated with dimethaminopropylamine (DMAPA) to virtually eliminate the problem. In certain embodiments, the amount of DMAPA employed is approximately 5% to 25 or 30%, on a molar basis, of the amount of maleic anhydride drafted to the polymer backbone.

Alternatively, amines with two or more reactive groups, especially primary groups, may be used in restricted amounts in order to provide an amount of branching or crosslinking to the polymeric composition. Suitable polyamines include ethylenediamine, diethyletriamine, propylenediamine, diaminocyclohexane, methylene-bis-cyclohexylamine, 2,7-diaminofluroene, ortho, meta, or para-xylenediamine, ortho, meta, or para-phenylenediamine, 4,4-oxydianiline, 1,5-, 1,8-, or 2,3-diaminonaphthalene, and 2,4-diaminotoluene. It has been discovered that the soot-handling properties of the dispersant-viscosity modifiers of the present invention can be further enhanced when a minor amount of a branching or crosslinking polyamine is incorporated. The amount of incorporation, however, should be restricted to those low levels that do not lead to gel formation or insolubility of the polymer. Exemplary amounts include 1 to 15, or 3 to 10, or 7 to 9, weight percent based on the total amines used, or alternatively 0.1 to 1, or 0.2 to 0.6, or 0.3 to 0.5 weight percent based on the polymer. Suitable amounts can be calculated such that about 1 molecule of primary amine will react with one acid functionality per polymer chain, leaving the remaining acid functionality to react with the (other) aromatic amines. Alternatively, if the acid functionality is provided by a diacid such as maleic acid or anhydride, then 1 primary amine can be reacted with one maleic anhydride moiety (containing 2 acid groups) per polymer chain, thereby reacting with both acid groups by imide formation.

The amount of the reacted aromatic amine on the polymer will typically comprise 2 to 10 percent by weight based on the weight of the polymer backbone, for example, 2 to 8 percent or 2.8 to 6.6 percent or 3 to 5 percent. These numbers represent the amount of aromatic amine monomer such as phenoxyphenylamine and may be adjusted to account for aromatic amines higher or lower molecular weights, as will be apparent to the person skilled in the art. The amount of the amine may, in certain embodiments, be a stoichiometric amount so as to react with the available carboxylic acid functionality on the polymer.

The amine can be introduced onto the polymer by condensing the amine with the acid functionality of the polymer or by pre-condensing the amine with a reactive acid monomer and incorporating the pre-condensed amine-containing monomer into or onto the polymer chain.

In certain embodiments of the present invention, the polymer component employed may comprise a mixture of multiple, that is, two or more, polymeric reaction products differing in amine type or in molecular weight or differing in both amine type and molecular weight. For example, a mixture of a polymer condensed with 3-nitroaniline can be used in combination with a polymer condensed with an amine comprising two aromatic moieties linked by an amide linkage. Likewise, a mixture of polymers having molecular weights of 12,000 and 40,000 may be employed. Such mixed molecular weight polymers may be condensation products of, for instance, 3-nitroaniline or any of the other appropriate aromatic amines.

The derivatized polymers of the invention are useful as an additive for lubricating oils. They are multi-functional additives for lubricants being effective in providing dispersancy, viscosity index improvement, anti-wear performance, and/or anti-oxidant properties to lubricating oils. They can be employed in a variety of oils of lubricating viscosity, including natural and synthetic lubricating oils and mixtures thereof. The novel derivatized graft copolymers can be employed in crankcase lubricating oils for spark-ignited and compression-ignited internal combustion engines. The compositions can also be used in gas engines, or turbines, automatic transmission fluids, gear lubricants, metal-working lubricants, hydraulic fluids and other lubricating oil and grease compositions. Their use in motor fuel compositions is also contemplated.

The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |

-continued

| Base Oil Category | Sulfur (%) | Saturates (%) | Viscosity Index |
|---|---|---|---|
| Group IV | All polyalphaolefins (PAOs) | | |
| Group V | All others not included in Groups I, II, III or IV | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from C5 to C12 monocarboxylic acids and polyols or polyol ethers. Other synthetic lubricating oils include liquid esters of phosphorus-containing acids, polymeric tetrahydrofurans, silicon-based oils such as the poly-alkyl-, polyaryl-, polyalkoxy-, or polyaryloxy-siloxane oils, and silicate oils. Hydrotreated naphthenic oils are also known and can be used, as well as oils prepared by a Fischer-Tropsch gas-to-liquid synthetic procedure as well as other gas-to-liquid oils. In one embodiment the composition of the present invention is useful when employed in a gas-to-liquid oil.

Unrefined, refined and rerefined oils, either natural or synthetic (as well as mixtures of two or more of any of these) of the type disclosed herein-above can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

In certain embodiments of the present invention, the oil of lubricating viscosity will have a kinematic viscosity at 100° C. of at least 3.5 $mm^2$/second, or alternatively at least 3.7 or at least 3.9 $mm^2$/s. In certain embodiments the kinematic viscosity at 100° C. will be up to 6 or up to 5 $mm^2$/s.

In general, the lubricating oil composition of the invention will contain the novel derivatized graft copolymer in a minor amount which is effective to provide VI improvement, dispersancy, anti-wear performance and/or antioxidant properties to the oil. A suitable concentration range is 0.1 to 3 wt. % of the derivatized graft copolymer based on the total weight of the oil composition. Another concentration range is 0.5 to 1.5 wt. % of the derivatized graft copolymer based on the total weight of the oil composition.

Concentrates of the derivatized graft copolymer may contain from 1 to 50 wt. % of the derivatized graft copolymer of the invention based on the total weight of the concentrate in a carrier or diluent oil of lubricating oil viscosity. The final oil-containing amine-reacted polymer can also, in this form, be shear degraded to reduce its molecular weight and increase its shear stability. In this case, a powerful liquid homogenizer can be used, such as one manufactured by APV Gaulin, Wilmington, Mass. and as described in greater detail in U.S. Pat. No. 5,538,651.

The polymers of the invention may be employed in lubricant compositions together with conventional lubricant additives. Such additives may include additional dispersants, detergents, anti-oxidants, pour point depressants, anti-wear agents, polymeric viscosity modifiers, and other materials that will be familiar to the person skilled in the art. For example, the polymers of the present invention may be employed together with an appropriate amount of a viscosity modifier of the hydrogenated styrene/conjugated diene type (that is, not condensed with an aromatic amine according to the present invention). Such viscosity modifiers are commercially available under the trade name Septon™.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

A dispersant is prepared from Mitsui's Lucant™ A-5320H polymer. Lucant A-5320 H is an amorphous Zieger-Natta copolymer of ethylene and propylene (GPC $\overline{M}_n$=7700) that is randomly grafted with maleic anhydride (in the presence of a free radical peroxide initiator in a high shear mixer) to a level of 3 weight % maleic anhydride. The final product has molecular weight (GPC polystyrene standards) $\overline{M}_n$=8810 and $\overline{M}_w$=17200 and Total Acid Number of 40 to 45 mg KOH/g. The Lucant A, 2600 g, is mixed with 5873 g diluent oil, warming the mixture to 110° C., and then adding 180 g 4-phenylazoaniline portion-wise over 30 minutes. The mixture is stirred at 110° C. for 30 minutes, then at 160° C. for 10.5 hours. The product is filtered using diatomaceous earth. Yield=8289 g, weight % nitrogen=0.46, kinematic viscosity at 100° C. ("KV"; D445_100)=79 $mm^2/s$ (cSt).

Example 2

A dispersant is prepared by diluting 180 g of Mitsui Lucant™ A 5320H with 398 g of diluent oil. The mixture is warmed to 70° C. and 700 mg of ethylenediamine dissolved in 15 mL of toluene is added drop-wise to the preparation over 75 min. The mixture is warmed to 110° C. and 7.9 g of 4-phenylazoaniline was added portion-wise over 20 min. The temperature is increased to 160° C. for 3.5 hr and the product is filtered using diatomaceous earth. Yield=558 g, % nitrogen=0.50. KV=158 $mm^2/s$.

Example 3

A dispersant is prepared by diluting 180 g of Mitsui Lucant™ A 5320H with 399 g of diluent oil. The mixture is warmed to 110° C. and 8.0 g of 4-phenylazoaniline is added portion-wise over 30 min. The preparation is held at 110° C. for 5.5 hr, then 700 mg of ethylenediamine is added drop-wise over 75 min. The preparation is held at 110° C. for 30 min, then warmed to 160° C. for 2 hr. The product is filtered through diatomaceous earth. Yield=555 g, % nitrogen=0.36, KV=152 $mm^2/s$.

Example 4

A dispersant is prepared by diluting 180 g of Mitsui Lucant™ A 5320H with 400 g of diluent oil. The mixture is heated to 160° C. and 7.9 g of 4-phenylazoaniline was added portion-wise over 20 min. The preparation is held at 160° C. for 4.5 hr, then 1.4 g of 2,4-diaminotoluene is added portion-wise over 30 min. Finally, the product is held at 160° C. for 2 hr and filtered with diatomaceous earth. Yield=562 g, % nitrogen=0.26, KV=141 $mm^2/s$.

Example 5

A dispersant is prepared by diluting 175 g of Mitsui Lucant™ A 5320H with 406 g diluent oil, warming the mixture to 110° C., and then adding 17.1 g of sulfamethazine portion-wise over 30 minutes. The mixture is stirred at 110° C. for 30 minutes, then at 160° C. for 18 hours. The product is filtered using diatomaceous earth. Yield=567 g, % nitrogen=0.46, KV=631 $mm^2/s$.

Example 6

A dispersant is prepared using the method of Example 5 with 175 g Lucant™ A 5320H, 401 g diluent oil, 15 g of 4-(4-nitrophenylazo)aniline and a hold time at 160° C. of 6.5 hr. Yield=564 g, % nitrogen=0.52, KV=171 $mm^2/s$.

Example 7

A dispersant is prepared using the method of Example 1 with 2067 g Lucant™ A 5320H, 4759 g diluent oil, 186 g of N-(4-amino-5-methoxy-2-methyl-phenyl)-benzamide (Fast Violet B) and a hold time at 160° C. of 6 hr. Yield=6639 g, % nitrogen=0.24, KV=296 $mm^2/s$.

Example 8

A dispersant is prepared using the method of Example 1 with 2025 g Lucant™ A 5320H, 4687 g diluent oil, 194 g of N-(4-amino-2,5-dimethoxyphenyl)-benzamide (Fast Blue RR) and a hold time at 160° C. of 7 hr. Yield=6570 g, % nitrogen=0.27.

Example 9

A dispersant is prepared using the method of Example 5 with 180 g Lucant™ A 5320H, 402 g diluent oil, 10.1 g of 4-aminoacetanilide and a hold time at 160° C. of 6 hr. Yield=556 g, % nitrogen=0.35, KV=557 $mm^2/s$.

Comparative Example 10

A comparative dispersant is prepared according to the method in Example 1 (except hold time at 160° C. is 4.5 hours instead of 7.5 hours) using 1600 g Lucant™ A 5320H, 3597 g diluent oil, and 103 g 4-aminodiphenylamine. Yield=5162 g, % nitrogen=0.374, KV=118 $mm^2/s$.

Comparative Example 11

A dispersant is prepared by the method of Example 2 with 180 g of Mitsui Lucant™ A 5320H, 397 g diluent oil, 700 mg of ethylene diamine, 30 mL of toluene, 7.4 g of 4-aminodiphenylamine and a hold time at 160° C. of 3 hr. Yield=548 g, % nitrogen=0.24, KV=224 $mm^2/s$.

Comparative Example 12

A dispersant is prepared by the method of Example 3 with 180 g of Mitsui Lucant™ A 5320H, 397 g diluent oil, 7.4 g 4-aminodiphenylamine, 700 mg ethylene diamine and a hold time at 160° C. of 5 hr. Yield=549 g, % nitrogen=0.20, KV=233 $mm^2/s$.

Comparative Example 13

A dispersant is prepared by the method of Example 1 with 3685 g of Lucant™ A 5320 H, 5875 g of diluent oil, 97 g of dimethylaminopropylamine, and a hold time at 160° C. of 5.5 hr. Yield=8219 g, % nitrogen=0.38, KV=67 $mm^2/s$.

Example 14

A dispersant is prepared according to the method in Example 1 with 2700 g Lucant A 5320H, 5995.9 g diluent oil, 139.8 g of 3-nitroaniline and a hold time at 170° C. of 10 hr. Yield=7690 g, % nitrogen=0.32, KV=105 $mm^2/s$.

Example 15

A dispersant is prepared according to the method in Example 1 with 1642 g Lucant A 5320H, 3708 g diluent oil, 114 g of 4-phenoxyaniline and a hold time at 160° C. of 5 hr. Yield=5256 g, % nitrogen=0.19, KV=86 $mm^2/s$.

Example 16

A dispersant is prepared by diluting 2300 g of Mitsui Lucant A 5320H with 5118 g of diluent oil. The mixture is warmed to 110° C. and 80 g of 4-phenoxyaniline is added portion-wise to the preparation over 30 minutes. The mixture is warmed to 160° C. for 3.5 hr. Dimethylaminopropylamine (44 g) is added drop-wise over 2 hr. The preparation is stirred at 160° C. for 3 hr., then filtered using diatomaceous earth. Yield=7195 g, KV=70 $mm^2/s$.

Example 17

A dispersant is prepared according to the method in Example 12 with 175 g Lucant A 5320H, 392.3 g diluent oil, 9.1 g of 4-phenoxyaniline, and 1.7 g dimethylaminopropylamine. Yield=552 g, % nitrogen=0.22, KV100=76 $mm^2/s$.

Example 18

A dispersant is prepared according to the method in Example 12 with 180 g Lucant A 5320H, 397.5 g diluent oil, 3.1 g of 4-phenoxyaniline, and 5.2 g dimethylaminopropylamine. Yield=561 g, % nitrogen=0.30, KV=68 $mm^2/s$.

Example 19

A dispersant is prepared according to the method in Example 12 with 175 g Lucant A 5320H, 395.3 g diluent oil, 9.5 g of 4-(4-nitrophenylazo)aniline, and 2.7 g dimethylaminopropylamine. Yield=5557 g, % nitrogen=0.51, KV=94 $mm^2/s$.

Example 20

A dispersant is prepared according to the method in Example 12 with 180 g Lucant A 5320H, 407.7 g diluent oil, 2.5 g of 4-(4-nitrophenylazo)aniline, and 10.6 g 4-phenoxyaniline. Yield=575 g, % nitrogen=0.21, KV=92 $mm^2/s$.

Example 21

A maleinated ethyl-propylene copolymer ($\overline{M}_n$=50,000, 2.3 weight % maleic anhydride), 70 g, is dissolved in 518 g diluent oil. The solution is warmed to 110° C. while purging with nitrogen. To the solution is added 2.3 g 3-nitroaniline, portion-wise over 30 minutes. The mixture is warmed to 160° C. and stirred at this temperature for 10 hours. Dimethylaminopropylamine (170 mg dissolved in 10 g diluent oil) is added dropwise at temperature over 1 hour, and the mixture is stirred for an additional 2 hours at 160° C. The resulting material is filtered through diatomaceous earth.

A soot-dispersive screen test is performed on several of the experimental samples prepared above. In this test, a specified amount (e.g., 1 wt. %) of the candidate chemistry is added to a used oil sample from the end of a test drain from a Mack™ T-11 engine test that exhibited a relatively high degree of viscosity increase. The sample is subjected to oscillation and the ability of the candidate to reduce the buildup of associations between molecules of soot is measured as a modulus, by a method described in Society of Automotive Engineers (SAE) Technical Paper 2001-01-1967, "Understanding Soot Mediated Oil Thickening: Rotational Rheology Techniques to Determine Viscosity and Soot Structure in Peugot XUD-11 BTE Drain Oils," M. Parry, H. George, and J. Edgar, presented at International Spring Fuels & Lubricants Meeting & Exhibition, Orlando, Fla., May 7-9, 2001. The calculated parameter is referred to as G'. The G' of the sample treated with the experimental chemistry is compared to the G' of the drain oil without the additive, the latter of which is defined as 1.00. Values of G' less than 1.00 indicate increasing effectiveness at soot dispersion.

| Dispersant from: | Aromatic amine component | G' at 1% dispersant |
|---|---|---|
| Example 1 | 4-phenylazoaniline | 0.08 |
| Example 2 | 4-phenylazoaniline + ethylenediamine | 0.02 |
| Example 3 | 4-phenylazoaniline + ethylenediamine | 0.02 |
| Example 4 | 4-phenylazoaniline + ethylenediamine | 0.02 |
| Comp. Ex. 10 | 4-aminodiphenylamine | 0.20 |
| Comp. Ex. 11 | 4-aminodiphenylamine + ethylenediamine | 0.03 |
| Comp. Ex. 12 | 4-aminodiphenylamine + ethylenediamine | 0.16 |

The results show that the product prepared with the 4-phenylazolaniline provides in general better soot dispersion than corresponding materials prepared using 4-aminodiphenylamine. Moreover, the additional presence of a small amount of a branching or crosslinking diamine such as ethylenediamine further leads to good soot dispersion performance.

The following table presents further soot screen test results for highly conjugated aromatic amine Lucant™ samples, results presented as G' values.

| Dispersant from: | Aromatic amine component | G', 0.5% | G', 1% | G', 2% |
|---|---|---|---|---|
| Example 5 | sulfamethazine | 0.26 | 0 | 0.02 |
| Example 6 | 4-(4-nitrophenylazo)aniline | 0.05 | 0.02 | 0.01 |
| Example 7 | Fast violet B | 0.03 | 0.01 | 0 |
| Example 8 | Fast violet blue RR | 0.06 | 0.01 | 0 |
| Example 9 | 4-aminoacetanilide | 0.34 | 0.09 | 0.03 |
| Example 14 | 3-nitroaniline | 0.36 | 0.10 | 0.02 |
| Example 19 | nitrophenylazoaniline + dimethylaminopropylamine | 0.26 | 0.10 | Not det'd. |
| Comp Ex. 13 | dimethylaminopropylamine | 0.33 | 0.18 | 0.10 |

The results show good performance by use of the aromatic amines of the present invention, especially at 1% and 2% dispersant levels.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a diesel engine equipped with exhaust gas recirculation, comprising supplying thereto a composition comprising an oil of lubricating viscosity and about 0.32 to about 1.5 weight percent of the condensation reaction product of:

(a) an olefin polymer comprising carboxylic acid functionality or a reactive equivalent thereof grafted onto the polymer backbone, said polymer having a number average molecular weight of greater than 5,000; and (b) an amine component comprising 3-nitroaniline.

2. The method of claim 1 wherein said polymer comprises an ethylene-alpha olefin copolymer containing grafted carboxylic functionality.

3. The method of claim 2 wherein said polymer comprises an ethylene-propylene copolymer, optionally containing at least one additional monomer derived from a non-conjugated diene.

4. The method of claim 1 wherein said polymer comprises an isobutylene/conjugated diene polymer containing grafted carboxylic functionality.

5. The method of claim 1 wherein said polymer comprises a substantially hydrogenated copolymer of styrene and a conjugated diene.

6. The method of claim 1 wherein the acid functionality or reactive equivalent thereof is provided by grafted maleic anhydride functionality.

7. The method of claim 1 wherein the amine component further comprises 4-(4-nitrophenylazo)aniline.

8. The method of claim 1 wherein the amine component further comprises at least one of an aminoquinoline, an aminobenzimidazole, an N,N-dialkylphenylenediamine, or a ring-substituted benzylamine.

9. The method of claim 1 wherein the amine component comprises, in addition to the 3-nitroaniline, an aliphatic amine having up to about 8 carbon atoms.

10. The method of claim 9 wherein the aliphatic amine comprises N,N-dimethylaminopropylamine or aminopropylmorpholine.

11. The method of claim 9 wherein the aliphatic amine comprises N,N-dimethylaminopropylamine.

12. The method of claim 9 wherein the aliphatic amine comprises ethylenediamine and is present in an amount of about 1 to about 15 weight percent of the total amine component present.

13. The method of claim 1 wherein the amine component further comprises a minor amount of a branching or crosslinking amine.

14. The method of claim 1 wherein the number average molecular weight of the polymer is greater than 5,000 to about 150,000.

15. The method of claim 1 wherein the amount of carboxylic monomers on the polymer is about 1 to about 5 weight percent.

16. The method of claim 1 wherein the amount of the reacted 3-nitroaniline is about 2.8 to about 6.6 weight percent of the polymer.

17. The method of claim 1 wherein the composition comprises a mixture of multiple polymeric reaction products differing in amine type or in molecular weight or both.

18. The method of claim 1 wherein the composition further comprises at least one material selected from the group consisting of additional dispersants, detergents, anti-oxidants, pour point depressants, anti-wear agents, and polymeric viscosity modifiers.

19. A lubricant composition comprising an oil of lubricating viscosity having a kinematic viscosity at 100° C. of at least 3.5 $mm^2$/second and about 0.32 to about 1.5 weight percent of the condensation reaction product of:

(a) an olefin polymer comprising carboxylic acid functionality or a reactive equivalent thereof grafted onto the polymer backbone, said polymer having a number average molecular weight of greater than 5,000; and (b) an amine component comprising 3-nitroaniline.

20. The lubricant composition of claim 19 further comprising at least one material selected from the group consisting of additional dispersants, detergents, anti-oxidants, pour point depressants, anti-wear agents, and polymeric viscosity modifiers.

21. A method of lubricating an internal combustion engine, comprising supplying thereto the lubricant composition of claim 19.

22. The method of claim 1 wherein the olefin polymer is selected from the group consisting of polymers of isobutylene and isoprene, substantially hydrogenated copolymers of vinyl aromatic materials and conjugated dienes, styrene-ethylene-alpha olefin polymers, polymers of ethylene and propylene, polymers of ethylene and a higher olefin within the range of ($C_3$-$C_{10}$) alpha-monoolefins, polymers containing a polyene monomer selected from conjugated or non-conjugated dienes and trienes, ethylene propylene copolymers further containing a non-conjugated diene, and isobutylene/conjugated diene copolymers.

23. The lubricant composition of claim 19 wherein the olefin polymer is selected from the group consisting of polymers of isobutylene and isoprene, substantially hydrogenated copolymers of vinyl aromatic materials and conjugated dienes, styrene-ethylene-alpha olefin polymers, polymers of ethylene and propylene, polymers of ethylene and a higher olefin within the range of ($C_3$-$C_{10}$) alpha-monoolefins, polymers containing a polyene monomer selected from conjugated or non-conjugated dienes and trienes, ethylene propylene copolymers further containing a non-conjugated diene, and isobutylene/conjugated diene copolymers.

* * * * *